US005730042A

United States Patent [19]

Engel

[11] Patent Number: 5,730,042

[45] Date of Patent: Mar. 24, 1998

[54] RETAINING DEVICE FOR AXIAL PISTON MACHINES

[75] Inventor: William K. Engel, Peoria, Ill.

[73] Assignee: Caterpillar Inc., Peoria, Ill.

[21] Appl. No.: 759,904

[22] Filed: Dec. 4, 1996

[51] Int. Cl.[6] ..... F01B 3/00; F01B 13/04

[52] U.S. Cl. ..... 92/12.2; 92/57; 92/71; 417/269

[58] Field of Search ..... 91/500; 92/12.2, 92/57, 71; 417/269

[56] References Cited

U.S. PATENT DOCUMENTS

| | | | |
|---|---|---|---|
| 3,611,879 | 10/1971 | Alderson | 91/490 |
| 3,641,829 | 2/1972 | Reynolds | 74/60 |
| 4,516,475 | 5/1985 | Fricke | 92/57 |
| 4,526,516 | 7/1985 | Swain et al. | 92/12.2 X |
| 4,862,789 | 9/1989 | Burgess et al. | 92/12.2 |
| 5,046,403 | 9/1991 | Riedhammer | 92/57 |
| 5,249,507 | 10/1993 | Kawahara et al. | 92/57 |
| 5,381,724 | 1/1995 | Kawahara et al. | 92/12.2 |

*Primary Examiner*—Hoang Nguyen
*Attorney, Agent, or Firm*—J. W. Burrows

[57] ABSTRACT

A retaining device for axial piston machines embodies a shoe plate with a plurality of openings radially disposed in it. On each side of each opening a substantially flat portion exists to maintain a tangential line of radial contact with the shoes. The shoe plate has a force transferring portion made up of a plurality of raised surfaces. The raised surfaces are arranged to apply two areas of axial contact on each shoe. The two areas of axial contact are generally diametrically opposed which keeps the shoes in sliding contact with the swash plate and thus substantially eliminates tipping of the shoes.

12 Claims, 3 Drawing Sheets

RETAINING DEVICE FOR AXIAL PISTON MACHINES

TECHNICAL FIELD

This invention relates generally to a retaining device for axial piston machines and more particularly to a piston shoe retaining device which substantially eliminates tipping of the piston shoes.

BACKGROUND ART

Many axial piston machines, such as hydraulic pumps and motors, use an adjustable swash plate to vary piston displacement. A piston shoe is connected to one end of each piston via a pivotal joint. Most of the remaining length of each piston is allowed to reciprocate in respective bores located in a rotatable barrel. As the pistons rotate with the barrel, the shoes slide along an inclined surface of the swash plate which results in the reciprocating motion of the pistons. It is necessary to maintain the sliding surface of the shoes in sliding contact with the swash plate at all times for proper operation of the axial piston machine.

A widely utilized design of piston shoe retaining device is one which axially contacts the bearing surface of the shoes over a large surface area. This design is usually embodied as a circular shoe plate with openings through which the neck portion of the shoes extend. In many cases, the openings are round holes and the bearing surface of the shoes is completely encircled. Having a large area of axial contact between the shoe plate and the bearing surface of the shoes causes problems.

One of the problems associated with current shoe plate designs that have a large area of axial contact between the shoe plate and the bearing surface of the shoes arises when distortion of the shoe plate occurs. A distorted shoe plate delivers unequal contact on the bearing surface of the shoes. This unequal contact between the shoes and the shoe plate results in the sliding surface of the shoes not being maintained in a flat, parallel orientation with respect to the swash plate, commonly referred to as tipping of the shoes.

Tipping of the shoes is a serious problem because the fluid bearing between the sliding surface of the shoes and the swash plate becomes disrupted and severe damage can result. As a tipped shoe travels along the inclined surface of the swash plate, the pressure from the exhaust stroke of the piston forces the shoe back into contact with the swash plate. A high pressure on the piston generates a force on the tipped shoe which causes the shoe to crash through the fluid bearing. Without the protection of the fluid bearing between the sliding surface of the shoe and the swash plate, galling or scuffing of the shoe and swash plate material can occur.

Another problem associated with current shoe plate designs is the magnification of side loading that occurs. Magnification of side loads between the shoe and shoe plate is seen particularly when the neck portion of the shoe extends through a round hole in the shoe plate. Under most operating conditions and with a round hole in the shoe plate, radial contact between the shoe and the shoe plate occurs at an angle to the tangential. Thus, any tangential load is magnified by the secant of the angle of contact between the shoe and shoe plate. The magnified side load on the shoe causes the shoe to tip away from the surface of the swash plate.

The present invention is directed to overcoming one or more of the problems as set forth above.

DISCLOSURE OF THE INVENTION

In the present invention, a retaining device is adapted for use in an axial piston machine. The axial piston machine has a swash plate and a plurality of shoes. The shoes are located generally along a reference circumferential centerline of the retaining device. Each shoe has a bearing surface and a sliding surface. The retaining device maintains the sliding surface of the shoes in sliding contact with the swash plate. The retaining device embodies a shoe plate having a plurality of openings defined in it which are radially positioned along the reference circumferential centerline. The shoe plate has a force transferring portion defined by a plurality of raised surfaces. The raised surfaces contact the respective shoe bearing surfaces.

BEST MODE FOR CARRYING OUT THE INVENTION

Figure 1:
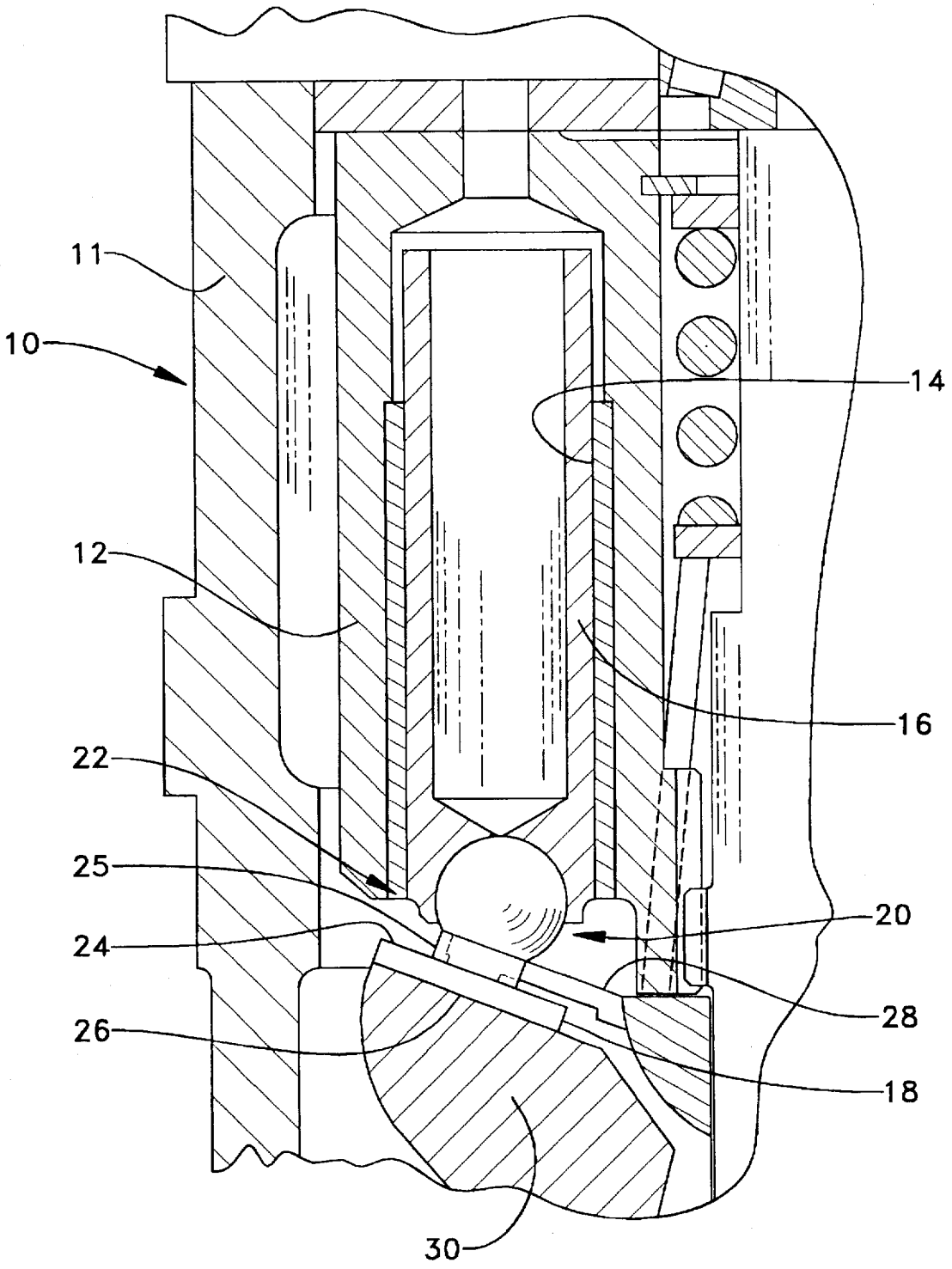
FIG. 1 is a diagrammatic representation of a cross-sectional view of a portion of an axial piston machine.

Referring to FIG. 1, an axial piston machine 10 such as a variable displacement hydraulic pump or motor has a housing 11, a rotatable barrel 12, a plurality of bores 14 located in the barrel 12, and a plurality of pistons 16 that reciprocate in the bores 14. A plurality of shoes 18 attached to the pistons 16 via pivotal joints 20 are such that a respective piston 16 and shoe 18 make up a piston assembly 22. Each shoe 18 has a bearing surface 24, a neck portion 25 and a sliding surface 26. A retaining device 28 is positioned to contact the bearing surface 24 of the shoes and adapted to maintain the sliding surface 26 of the shoes in sliding contact with an adjustable swash plate 30.

Figure 2:
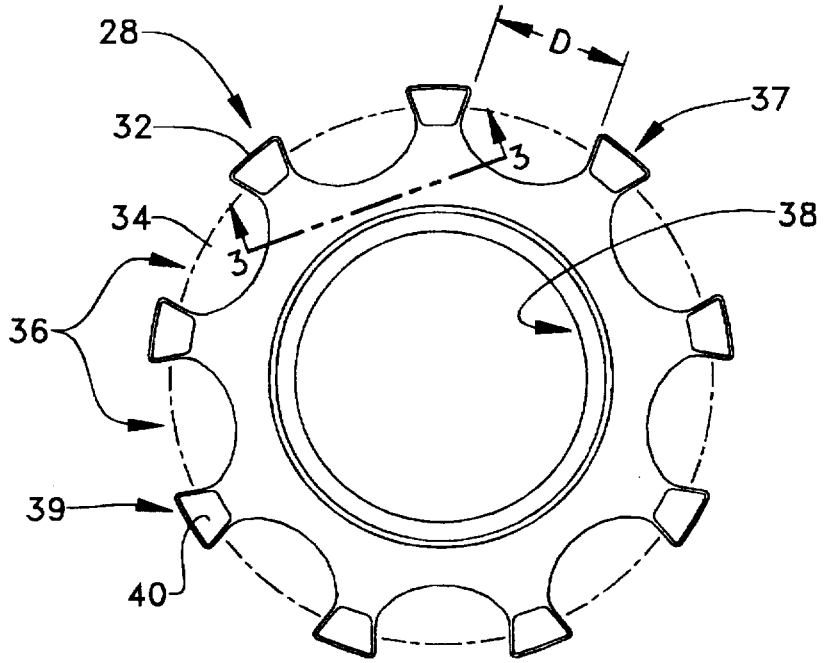
FIG. 2 is a diagrammatic representation of a bottom view of the retaining device.

The retaining device 28 as shown in FIG. 2 is a shoe plate 32 illustrated with a reference circumferential centerline 34. The reference circumferential centerline 34 represents the average centerline of the circular and elliptical paths in which the shoes 18 travel as the swash plate 30 is adjusted from minimum to maximum displacement. The shoe plate 32 has a plurality of openings 36 defined in it which are radially positioned about the reference circumferential centerline 34. A distance (D) across each opening 36 is sufficient to accommodate the neck portion 25 of the respective shoes 18. The shoe plate 32 has an outer portion 37 and an inner portion 38. In the preferred embodiment, the openings 36 extend radially outward, beyond the outer portion 37. A force transferring portion 39 of the shoe plate 32 is made up of a plurality of raised surfaces 40.

Figure 3:
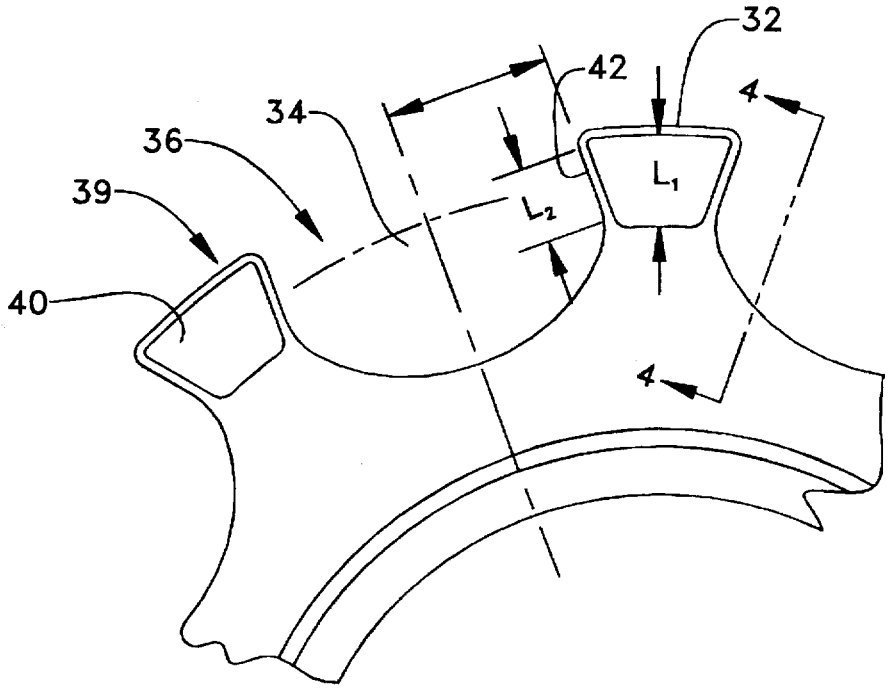
FIG. 3 is a diagrammatic representation of an enlarged sectional view of the force transferring portion of the retaining device of FIG. 2.

FIG. 3 shows an enlarged sectional view of the force transferring portion 39 with the raised surfaces 40. In the preferred embodiment, each raised surface 40 extends across the force transferring portion 39 between each respective opening 36 and is positioned generally along the reference circumferential centerline 34. Each of the raised surfaces 40 has a pre-determined radial length ($L_1$) approximately in the range of 10% to 25%, preferably about 15% of the distance (D) across one of the openings 36.

When the raised surfaces 40 have a radial length ($L_1$) which extends above the upper end of the stated range, the amount of axial contact between each of the raised surfaces 40 and the bearing surface 24 of the shoe 18 becomes larger than desired. The large area of axial contact between each of the raised surfaces 40 and the bearing surface 24 allows for unequal axial contact between the shoe plate 32 and the shoes 18, particularly when the shoe plate 32 becomes distorted. The unequal axial contact leads to tipping of the shoes 18.

Similarly, when the raised surfaces 40 have a radial length ($L_1$) which falls below the lower end of the stated range, the amount of axial contact between each of the raised surfaces 40 and the bearing surface 24 of the shoes 18 becomes less than desired. Having a small area of axial contact between each of the raised surfaces 40 and the bearing surface 24, subjects the bearing surface 24 to high axial contact pressure. The high axial contact pressure applied to the bearing surface 24 causes excessive wear at the interface between the bearing surface 24 and the raised surfaces 40 and decreases the useful operating life of the shoes 18 and the shoe plate 32.

FIG. 3 illustrates that the openings 36 in the shoe plate 32 have substantially flat portions 42 located on opposite sides of the openings 36. The flat portions 42 are located substantially parallel to respective reference radial centerlines that extend from the center of the shoe plate 32 through the center of respective openings 36. These flat portions 42 engage in radial contact with the shoes 18 in an area generally above the bearing surface 24. The flat portions 42 of the openings 36 are located generally along the circumferential centerline 34. Each flat portion 42 has a radial length ($L_2$) generally equal to the radial length ($L_1$) of each raised surface 40.

Figure 4:
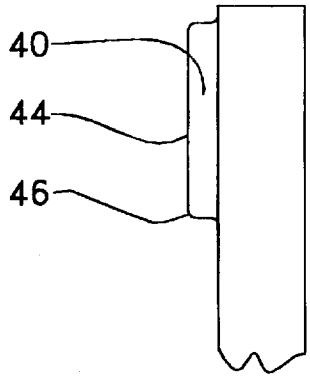
FIG. 4 is diagrammatic representation of a sectional view of one of the raised surfaces on the force transferring portion of FIG. 3.

FIG. 4 shows that each raised surface 40 has a substantially flat portion 44. The flat portion 44 contacts a bearing surface 24 of the shoes 18 to maintain the sliding surface 26 of the shoes 18 in sliding contact with the swash plate 30. Each of the raised surfaces 40 have a plurality of edges 46 adjacent the flat portions 44. Many variations in shape can be applied to the edges 46 such as squared, beveled, chamfered, tapered, etc. However, in the preferred embodiment, the edges 46 are rounded.

Figure 5:
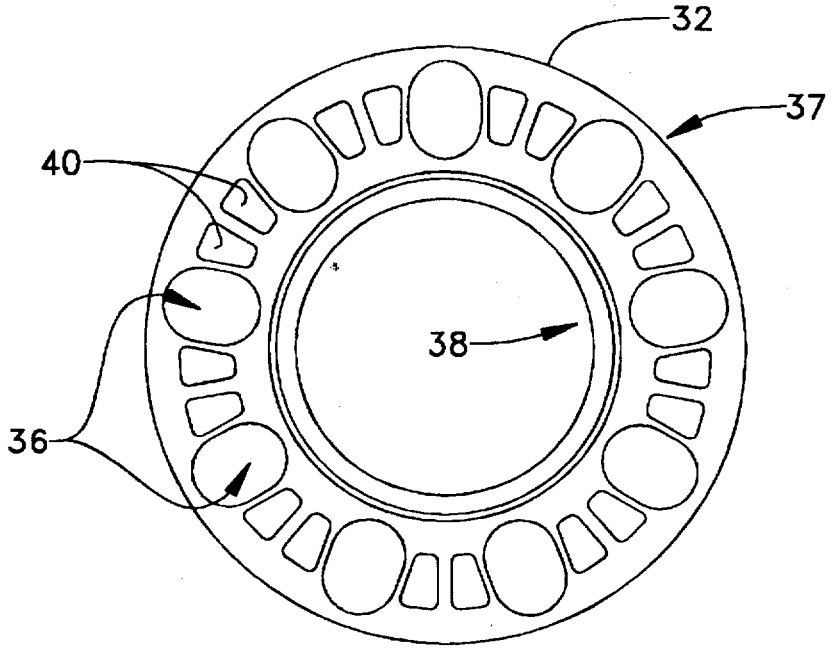
FIG. 5 is a diagrammatic representation of a bottom view of an alternate embodiment of the retaining device of FIG. 2.

An alternate embodiment of a shoe plate 32 of the present invention is shown in FIG. 5. It is noted that the same reference numerals of the first embodiment are used to designate similarly constructed counterpart elements of this embodiment. In this embodiment, however, each raised surface 40 is shown segmented into two or more portions. The segmentation of each raised surface 40 can likewise be applied to the embodiment of the shoe plate 32 shown in FIG. 2. Also, the plurality of openings 36 are shown bounded by both the outer portion 37 and the inner portion 38 of the shoe plate 32. This embodiment showing the openings 36 bounded by the outer portion 37 and the inner portion 38 can incorporate the non-segmented raised surfaces 40 as shown in FIG. 2. It is recognized that various other embodiments of the shoe plate 32 can be achieved by utilizing different combinations of the features stated herein.

Industrial Applicability

In the axial piston machine 10 the shoe plate 32 is the device which maintains the shoes 18 in sliding contact with the swash plate 30. The force transferring portion 39 on the shoe plate 32 utilizes the plurality of raised surfaces 40 to maintain axial contact with the bearing surface 24 of the shoes 18. The raised surfaces 40 are arranged generally along the circumferential centerline 34 so as to contact the bearing surface 24 in areas that are generally diametrically opposed.

Even if the shoes 18 change position within the openings 36 as a result of changing the angle of the swash plate 30, the raised surfaces 40 are still able to maintain generally diametrically opposed axial contact with the bearing surface 24 of the shoes 18. With the raised surfaces 40 providing the only areas of generally diametrically opposed axial contact, symmetrical loading on the shoes 18 results. The symmetrical loading allows the sliding surface 26 of the shoes 18 to maintain a flat parallel orientation with respect to the swash plate 30 and substantially eliminates tipping of the shoes 18. The raised surfaces 40 are able to apply generally diametrically opposed axial contact even if the shoe plate 32 becomes somewhat distorted.

The flat portions 42 within the openings 36 allow the shoes 18 to apply a tangential driving force on the shoe plate 32 as the piston assemblies 22 rotate with the barrel 12. The tangential driving force substantially eliminates force magnification on the shoes 18. The elimination of force magnification reduces disruptive influence on the sliding surface 26 of the shoes 18 and further eliminates tipping of the shoes 18.

Other aspects, objects, and features of the present invention can be obtained from a study of the drawings, the disclosure, and the appended claims.

I claim:

1. A retaining device adapted for use in an axial piston machine having a swash plate and a plurality of shoes disposed generally along a reference circumferential centerline of the retaining device, each shoe having a bearing surface, a neck portion adjacent the bearing surface, and a sliding surface, the retaining device being adapted to maintain the sliding surface of the shoes in sliding contact with the swash plate, the retaining device comprising:

a shoe plate having a plurality of openings disposed radially and generally along said reference circumferential centerline and a force transferring portion having a plurality of raised surfaces of pre-determined radial length disposed generally along the reference circumferential centerline, respective ones of said raised surfaces being in contact with the respective shoe bearing surfaces.

2. The retaining device, as set forth in claim 1, wherein each raised surface extends across said force transferring portion from one of the openings to an adjacent opening.

3. The retaining device, as set forth in claim 1, wherein each raised surface is segmented into two or more portions.

4. The retaining device, as set forth in claim 1, wherein each raised surface includes a substantially flat portion arranged to contact one of said shoe bearing surfaces.

5. The retaining device, as set forth in claim 1, wherein each raised surface has a radial length approximately in the range of 10% to 25% of the distance across one of said plurality of openings.

6. The retaining device, as set forth in claim 1, wherein each raised surface has a plurality of edges, said edges being rounded.

7. The retaining device, as set forth in claim 1, wherein the openings in said shoe plate include a substantially flat portion on each side of each opening, said substantially flat portions being located generally along the reference circumferential centerline.

8. The retaining device, as set forth in claim 7, wherein each substantially flat portion has a radial length generally equal to the radial length of each raised surface.

9. The retaining device, as set forth in claim 1, wherein said shoe plate has an outer portion and an inner portion.

10. The retaining device, as set forth in claim 9, wherein each opening extends radially outward beyond said outer portion of the shoe plate.

11. The retaining device, as set forth in claim 9, wherein each opening is bounded by said outer portion and said inner portion of the shoe plate.

12. A retaining device adapted for use in an axial piston machine having a swash plate and a plurality of shoes disposed generally along a reference circumferential centerline of the retaining device, each shoe having a bearing surface, a neck portion adjacent the bearing surface, and a sliding surface, the retaining device adapted to maintain the sliding surface of the shoes in sliding contact with the swash plate, the retaining device comprising:

a shoe plate having a plurality of openings disposed radially and generally along said reference circumferential centerline;

a force transferring portion located on the shoe plate and adapted to contact the respective shoe bearing surfaces, said force transferring portion having a plurality of raised surfaces disposed generally along the reference circumferential centerline;

a substantially flat portion located on the force transferring portion and having a radial length approximately in the range of 10% to 25% of the distance across one of said plurality of openings;

a plurality of rounded edges located on the force transferring portion adjacent the substantially flat portion; and a plurality of substantially flat portions located on opposite sides of said openings and generally along said reference circumferential centerline, said substantially flat portions adapted to contact the neck portion of the shoes.

* * * * *